United States Patent [19]

Faulkner et al.

[11] Patent Number: 4,656,392

[45] Date of Patent: Apr. 7, 1987

[54] ELECTRON DISCHARGE DEVICE HAVING A THERMIONIC EMISSION-REDUCTION COATING

[75] Inventors: Richard D. Faulkner; Robert E. McHose, both of Lancaster, Pa.

[73] Assignee: RCA Corporation, Princeton, N.J.

[21] Appl. No.: 546,478

[22] Filed: Oct. 28, 1983

[51] Int. Cl.[4] ..... H01J 43/18

[52] U.S. Cl. ..... 313/533; 313/543; 313/107; 427/77

[58] Field of Search ..... 313/532, 533, 541, 543, 313/106, 107; 427/77

[56] References Cited

U.S. PATENT DOCUMENTS

| | | | |
|---|---|---|---|
| 2,027,025 | 1/1936 | De Boer et al. | 250/27.5 |
| 2,189,322 | 2/1940 | Flory | 250/165 |
| 2,273,637 | 2/1942 | Glover | 250/165 |
| 3,327,152 | 6/1967 | Greilich | 313/99 |
| 3,350,591 | 10/1967 | Van Asselt | 313/65 |
| 3,372,967 | 3/1968 | Hughes | 316/5 |
| 3,906,274 | 9/1975 | Silver et al. | 313/641 |
| 3,932,783 | 1/1976 | Mewelly et al. | 313/492 |

OTHER PUBLICATIONS

*Electronic Processes in Materials,* by Azároft et al, 1963, pp. 313–316.

Photomultiplier Handbook, RCA PMT-62, pp. 19–21, 53–62.

G. N. Butterwick, "Oil Exploration with Photomultiplier Tubes", RCA Engineer, pp. 62–65, vol. 24, No. 5, Feb./Mar. 1979.

*Primary Examiner*—S. Leon Bashore

*Assistant Examiner*—Michael K. Boyer

*Attorney, Agent, or Firm*—Eugene M. Whitacre; Dennis H. Irlbeck; Vincent J. Coughlin, Jr.

[57] ABSTRACT

An electron discharge device, such as a photomultiplier tube, has an evacuated envelope with an alkali-antimonide photoemissive cathode therein. A thermionic emission-reduction coating is disposed within the envelope. The coating alloys with the constituents of the photoemissive cathode to reduce thermionic emission. The thermionic emission reduction coating is formed preferably of indium; however, indium oxide may also be used.

6 Claims, 2 Drawing Figures

ELECTRON DISCHARGE DEVICE HAVING A THERMIONIC EMISSION-REDUCTION COATING

BACKGROUND OF THE INVENTION

The invention relates to electron discharge devices and particularly to photomultiplier tubes having a thermionic emission-reduction coating.

Photomultiplier tubes for use in severe environments, such as for oil-well logging, are described in U.S. Pat. No. 4,355,258, issued to G. N. Butterwick on Oct. 19, 1982, and incorporated by reference herein for the purpose of disclosure. Logging is a term given to the method of determining the mineral composition and structure of the geological media along bore holes.

Sensitive probes, or sondes, are used to determine the lithology, i.e., the character of the rock formation, including the density, of the media along the bore hole. The bore holes are typically thousands of meters deep and may exceed about ten-thousand meters. Temperature increases with bore hole depth, and the temperature in a ten-thousand meter deep hole may range between 100° to 250° C. In logging such a hostile environment, the sondes, which include a radioactive gamma ray source, such as cesium 137, and a detector comprising a sodium iodide crystal and a photomultiplier tube, are subjected to shock and vibration as well as to high operating temperatures.

Gamma rays from the cesium 137 source enter the medium surrounding the bore hole, and interactions occur among the gamma rays and the orbital electrons in the atoms of the material comprising the medium. The interactions impart energy to the orbital electrons and redirect or scatter photons of lower energy than the incident gamma rays in a direction different from that of the incident gamma rays. This effect is called the Compton Effect. Some of the scattered photons are detected by the sodium iodide crystal which converts them to luminous scintillations. The luminous scintillations are then detected by a photoemissive cathode and converted into electrical pulses by an electron multiplier of the photomultiplier tube. The electrical pulses represent Compton photon energy data which may then be converted into a geological formation-density log. A more complete description of oil-well logging is contained in an article by G. N. Butterwick, entitled, "Oil Exploration With Photomultiplier Tubes", published in the RCA Engineer, pp. 62–65 (Vol. 24, No. 5, February/-March 1979).

The photoemissive cathode or photocathode of the photomultiplier tube is adversely affected by the high operating temperatures encountered in logging deep bore holes. As the temperature increases, the dark current of the tube, particularly the thermionic component of the dark current, also increases, thus decreasing the signal-to-noise ratio of the tube. Thermionic emission generally originates from the photocathode itself or from other surfaces in the tube on which alkali materials have been deposited, and is then amplified by the gain of the electron multiplier section of the tube. Typically, the photocathode is formed not only on the inside surface of the faceplate but also along the upper sidewall of the tube adjacent to the faceplate. FIG. 1 is a graph of the typical thermionic-emission current density for various types of photocathodes, as a function of temperature. Oil-well logging tubes, such as the RCA C31016G, utilize a high temperature, low-noise photocathode, such as the sodium-potassium-antimony ($Na_2KSb$) photocathode which is deposited in situ and is indicated at the extreme left-side of FIG. 1; nevertheless, at temperatures above 100° C., the thermionic emission is severe. It is known in the art to cool the photomultiplier tube and reduce the thermionic emission by means of a cryostat; however, on some types of photocathodes, too cool a temperature may result in the photocathode becoming so resistive that the photoemission is blocked by a drop in potential across the photocathode surface. Another way of decreasing the thermionic emission is to minimize the electron emission surface of the photocathode by restricting the emission surface to the useful faceplate area and by preventing the formation of the photocathode on the sidewall. U.S. Pat. No. 3,372,967, issued to F. R. Hughes on March 12, 1968, discloses an antimony evaporator shield which restricts the deposition of antimony to the faceplate of the tube. The subsequently deposited alkali metals react with the antimony to form a photocathode only on the faceplate of the tube. Such a shielding structure is not always feasible, especially in a small tube such as the C31016G, where the mechanical shield may interfere with the electron optics of the tube, and other means are frequently required to restrict the cathode area so as to minimize thermionic emission.

U.S. Pat. No. 3,327,152, issued to A. L. Greilich on June 20, 1967, discloses photoemissive retardant agents, such as iron, tin, lead and the chloride of nickel, which are deposited on a grid of a grid-controlled phototube and interact with the alkali metals to provide a high work function grid surface from which the electrons cannot escape, thus reducing the dark current emission from the grid. The photoemissive cathode described in the Greilich patent utilizes a metal substrate for a structural support. Antimony is deposited on the substrate prior to the mounting of the substrate, grid and anode in the tube envelope. An alkali material, such as cesium, is introduced into the tube to react with the antimony and to form the photoemissive cathode. The retardant agents described in the Greilich patent would be ineffective in reducing thermionic emission from Applicants' photomultiplier tube, since Applicants' photocathode, including the base layer of antimony, is deposited in situ. In such a structure, antimony would cover the retardant agents, and a photoemissive cathode would be formed over the retardant material, and therefore no decrease in thermionic emission would occur.

SUMMARY OF THE INVENTION

An improved electron discharge device comprises an evacuated envelope having therein an alkali-antimonide photoemissive cathode. The envelope has a thermionic emission-reduction coating deposited therein. The thermionic emission-reduction coating alloys with the constituents of the photoemissive cathode to reduce thermionic emission.

DETAILED DESCRIPTION OF THE PREFERRED EMBODIMENT

Figure 1:
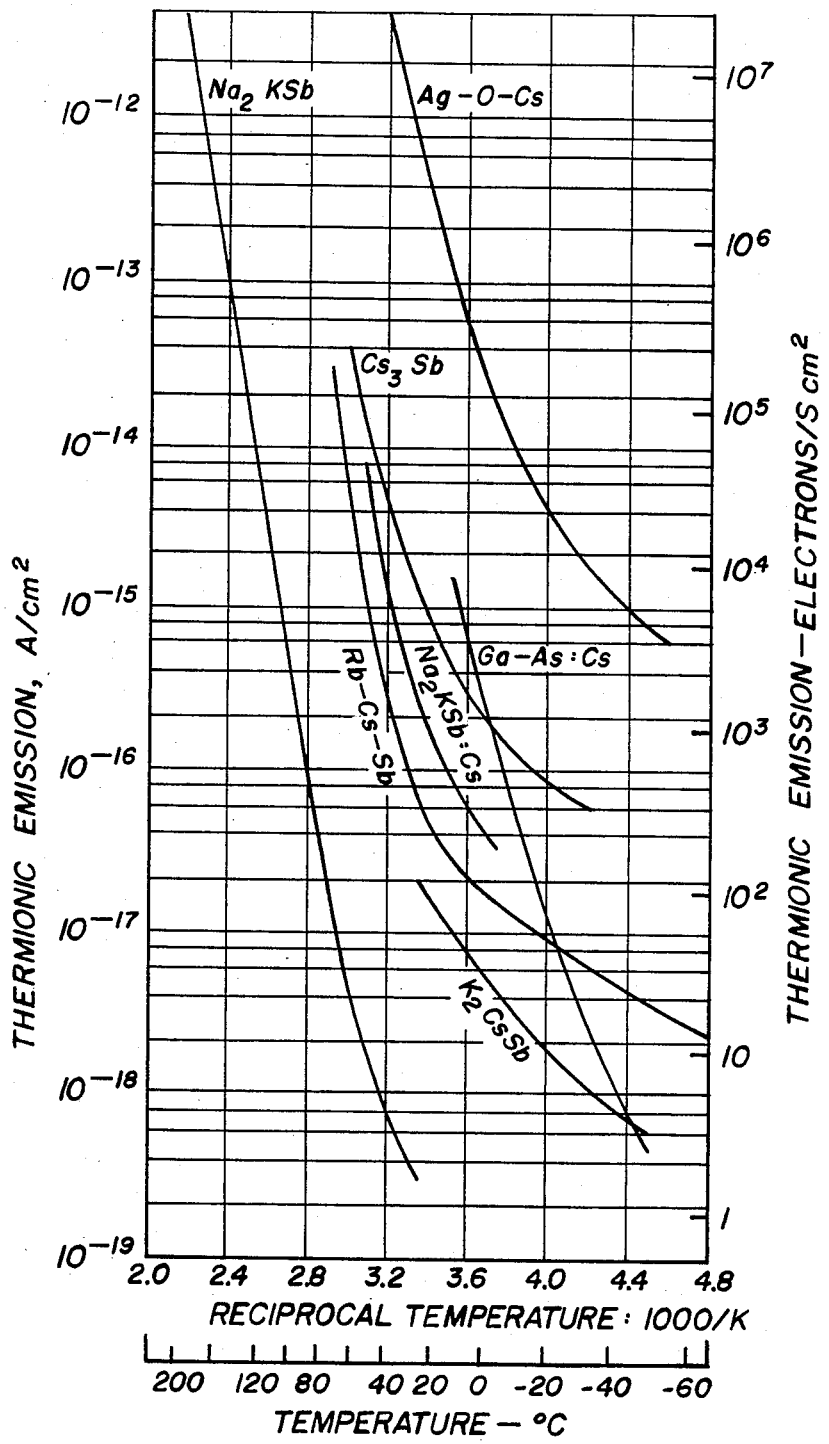
FIG. 1 is a graph indicating the effect of temperature on thermionic emission for several conventional photoemissive cathodes.
Figure 2:
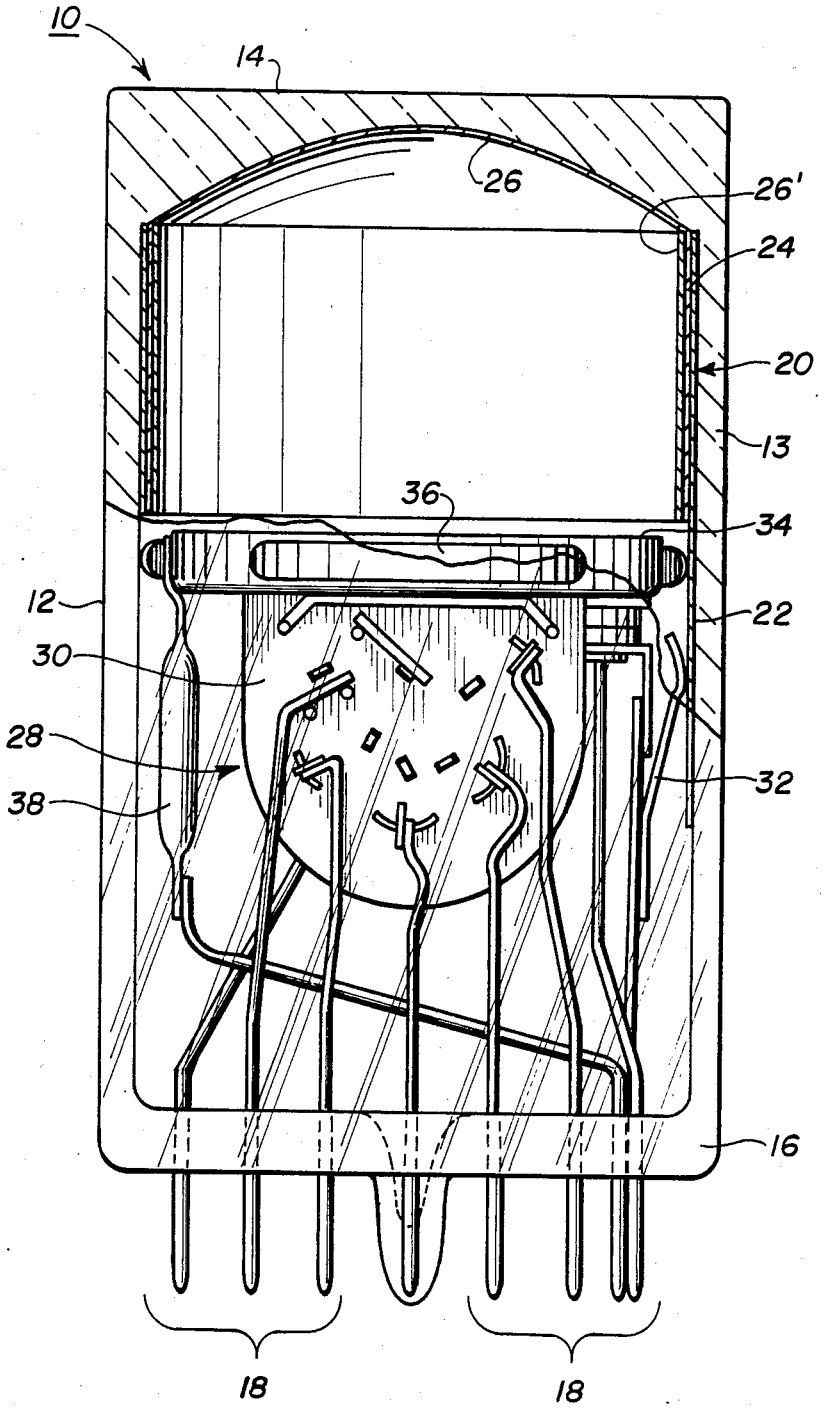
FIG. 2 is a partially broken-away view of a photomultiplier tube embodying the present invention.

Referring to the drawings, there is shown in FIG. 2 a photomultiplier tube 10 comprising an evacuated envelope 12 having a generally cylindrical sidewall 13 closed at one end by a transparent faceplate 14. A stem 16, through which a plurality of relatively stiff leads 18 extend, closes the other end of the envelope. An aluminum coating 20 is deposited as an annular ring on the upper inner surface of the sidewall 13. A projection 22 of the aluminum coating 20 extends longitudinally along a portion of the sidewall 13. A novel conductive thermionic emission reduction coating 24 is formed on at least a portion of the aluminum coating 20. The thermionic emission reduction coating 24 is described in detail below. A photoemissive cathode or photocathode 26, preferably an alkali-antimonide structure comprising sodium, potassium and antimony in a stoichiometric ratio of about two parts sodium to about one part each of potassium and antimony, is formed on the interior surface of the faceplate 14. The photocathode constituents are also deposited as a layer 26' along the upper inner surface of the sidewall 13 overlying the thermionic emission-reduction coating 24. The photocathode 26 may be made by the method for making a high temperature-stable sodium-potassium-antimony photocathode described in U.S. Pat. No. 3,838,304, issued to A. F. McDonie on Sept. 24, 1974, and assigned to the assignee of the present invention, and which is incorporated by reference herein for the purpose of disclosure.

An electron multiplier assembly 28 is disposed within the tube 10, in spaced relation with the photocathode 26 on the faceplate 14. The multiplier assembly 28 comprises a plurality of elements including secondary emissive dynodes and an anode. The C31016G utilizes ten closely-spaced dynodes arranged in a circular configuration well known in the art and shown, for example, in U.S. Pat. No. 2,818,520, issued to R. W. Engstrom et al. on Dec. 31, 1957, and incorporated herein for the purpose of disclosure. The anode of the multiplier assembly 28 is disposed within the last dynode. The dynodes and the anode are disposed between a pair of spaced, substantially parallel, insulative support spacers 30 (only one of which is shown in FIG. 2). Each of the dynodes and the anode has a pair of oppositely disposed ends which extend through apertures in the dynode spacers 30 and provide means for electrically connecting internal projections of the stem leads 18 to the elements of the electron multiplier assembly 28. While the electron multiplier 28 comprises ten dynodes and an anode, only five connections are shown in FIG. 2. The remaining electrical connections extend from the opposite side of the assembly 28 and are not shown. A resilient cathode contact 32 is attached at one end to one of the stem leads 18. The contact 32 is urged against the aluminum projection 22 on the sidewall 13 which is electrically connected to the photocathode 26.

A shield cup 34, having an aperture (not shown) which permits photoelectrons from the photocathode 26 to enter the multiplier assembly 28, is disposed between the photocathode 26 and the multiplier assembly 28, and is attached to the support spacers 30 of the multiplier assembly. A plurality of bulb spacers 36 are disposed circumferentially around the shield cup 34 to center the shield cup and the attached multiplier assembly 28 within the envelope 12. An antimony source (not shown) is disposed within the shield cup 34 in a manner similar to that shown in U.S. Pat. No. 4,306,188, issued to J. L. Ibaugh on Dec. 15, 1981, and incorporated by reference herein for the purpose of disclosure. At least one alkali metal vapor source 38 is provided for the alkali-antimonide photocathode; preferably, there are two sources, one providing sodium vapor and the other providing potassium vapor to form the high temperature-stable photocathode 26.

In the preferred embodiment described herein, the thermionic emission-reduction coating 24 comprises indium; however, indium oxide may also be used. The indium is applied by conventional techniques, such as evaporating, sputtering or plating, to a thickness within the range of about 300 Å (Angstroms) to about 0.05 mm; however a thickness of about 2500 Å is preferred. The indium may be applied as an annular ring over the aluminum coating 20, as shown; alternatively, the aluminum coating 20 may be omitted. If the aluminum coating 20 is omitted, then the indium coating 24 must include a projection, similar to the aluminum projection 22, extending longitudinally along the sidewall 13 to provide a means for the cathode contact 32 to contact the photocathode 26.

THEORY OF OPERATION

During the formation of the photocathode 26, antimony is evaporated from an antimony source within the shield cup 34 and deposited as a film on the interior surface of the faceplate 14 and also on the indium thermionic emission-reduction coating 24 on the sidewall 13. The next step is to heat the tube within the range of 160° C.–200° C. and to evaporate potassium from one of the sources 38 for deposition onto the above-described antimony film. Then, the tube temperature is increased within the range of 200° C.–250° C., and sodium is evaporated from the other source 38 and deposited on the potassium-antimony surface. Additional amounts of antimony, potassium and sodium are added in the manner described in the above-referenced U.S. Pat. No. 3,838,304, until a maximum photosensitivity is achieved.

During the processing of the photocathode 26, the antimony deposited on the indium coating 24 begins to alloy with the indium at a temperature of 155° C. The subsequently added photocathode constituents of potassium and sodium also alloy with the antimony-indium to form the high work function layer 26' (on the sidewall) which is non-photoemissive and which has negligible thermionic emission over the operating temperature range of the photomultiplier tube. The novel indium coating 24 thus effectively reduces the useful photocathode area to the interior surface of the faceplate 14 by absorbing and alloying with the antimony, potassium and sodium deposited thereon.

While the thermionic emission-reduction coating 24 is described in the embodiment of an oil-well logging photomultiplier tube, such as the C31016G, which is subjected to high operating temperatures, the coating 24 can be used advantageously on any photoemissive device where reduction of thermionic emission is a consideration. For example, photomultiplier tubes used in applications where single photon events must be detected can also benefit by the improvement in signal-to-noise ratio provided by the novel thermionic emission reduction coating 24. Furthermore, since the indium coating 24 alloys with the alkali metals used in the formation of photoemissive surfaces, indium can be deposited on other areas of the tube to getter excess alkali material generated during the formation of the photocathode.

TEST RESULTS

A number of RCA photomultiplier tubes designed for oil-well logging were tested for high-low pulse-height ratio with and without the novel indium coating on the sidewall of the envelope. The parameter of pulse height is measured by optically coupling the faceplate of a photomultiplier tube to a thallium doped, sodium iodide crystal scentillator. A cesium 137 source provides monoenergetic (662 keV) gamma rays which lose all of their energy by photoelectric conversion in the crystal. An operating voltage of about 1500 volts is applied to the photomultiplier tube by means of a voltage divider of a type well known in the art. The output of the photomultiplier tube is connected to and displayed on a multichannel analyzer. A detailed description of scintillation counting may be found in *The RCA Photomultiplier Handbook* (PMT-62) pp. 69–72 (1980) which is incorporated by reference herein for the purpose of disclosure.

It is known that pulse height is dependent on temperature and relatively independent of tube geometry and gain. As the temperature increases, the magnitude of the photomultiplier tube output pulse decreases because of a decrease in photocathode sensitivity and crystal scintillation efficiency. At the same time, thermionic emission from the photocathode increases until, at a temperature near 200° C., the desired signal is lost in the background thermal noise.

High-low pulse-height ratio, in percent, is defined as 100 times the ratio of the pulse height measured at 200° C. to the pulse height measured at room temperature.

A first group of six tubes (5 standard tubes and 1 tube having the novel indium thermionic emission-reduction coating) were thermal cycled from room temperature to 175° C. The tubes were held at 175° C. for four hours and the cycling was repeated five times. The sixth cycle was from room temperture to 200° C. The tubes were held at 200° C. for three hours before being pulse height tested. Only the tube with the novel indium coating had a low enough noise level to resolve the cesium 137 energy peak. All six tubes were cycled once more from room temperature to 175° C. before the tubes were cooled to room temperature and retested for photocathode sensitivity. The sensitivity test showed that only the tube with the indium coating on the sidewall retained sufficient photocathode sensitivity after the above-described thermal cycling. The tube with the indium coating showed a decrease in photocathode sensitivity of only 15 percent, whereas the other five tubes without the indium coating decreased in photocathode sensitivity from 35 to 75 percent.

The thermal cycling was repeated on two additional photomultiplier tubes having the novel indium coating on the sidewall. The tubes were cycled from room temperature to 175° C. and tested for high-low pulse-height ratio. One tube had a high-low ratio of 40 percent and the other tube had a high-low ratio of 41 percent. By way of comparison, standard tubes (i.e., without an indium coating on the sidewall) typically have 175° C. high-low ratios ranging from 20 to 25 percent. The improvement achieved using the indium coating is significant and indicates that the indium coating reduces the thermionic emission of the tube by alloying with the photoemissive constituents on the sidewall of the envelope.

What is claimed is:

1. In an electron discharge device comprising an evacuated envelope having therein an alkali-antimonide photoemissive cathode, the improvement comprising a thermionic emission-reduction coating disposed on a portion of said envelope between said envelope and an overlying portion of said photoemissive cathode and alloying with the constituents thereof, thereby forming a layer having reduced thermionic emission wherein said thermionicemission-reduction coating is selected from the group consisting of indium and indium oxide.

2. In a photomultiplier tube comprising an evacuated envelope having a faceplate and a sidewall, said faceplate and said sidewall each having an interior surface, an alkali-antimonide photoemissive cathode on said interior surfaces of said faceplate and of said sidewall, and an electron multiplier assembly spaced from said photoemissive cathode on said faceplate, the improvement comprising a thermionic emission-reduction coating disposed on said interior surface of said sidewall alloyed with the alkali-antimonide constituents of said photoemissive cathode overlying said coating, thereby forming a layer having reduced thermionic emission wherein said thermionic emission-reduction coating is selected from the group consisting of indium and indium oxide.

3. The tube as in claim 2, wherein said coating has a thickness within the range of about 300Å to 0.05 mm.

4. The tube as in claim 2, wherein said coating has a thickness of about 2500Å.

5. A method of making a photomultiplier tube having an evacuated envelope with a sidewall closed at one end by a faceplate including the steps of providing a thermionic emission-reduction coating selected from the group consisting of indium and indium oxide on an interior surface of said sidewall, and depositing an alkali-antimonide photoemissive cathode on an interior surface of said faceplate, said constituents of said alkali-antimonide photoemissive cathode also being deposited on said coating on said sidewall and alloying therewith, thereby forming a high work function layer for reducing thermionic emission from said sidewall.

6. The method as described in claim 5 further including the step of applying said thermionic emission-reduction coating to a thickness within the range of about 300Å to about 0.05 mm.

* * * * *